US005657694A

United States Patent [19]

Weishew

[11] Patent Number: 5,657,694

[45] Date of Patent: Aug. 19, 1997

[54] METHOD OF AND APPARATUS FOR LOADING A WIPER ROLL AGAINST AN ANILOX ROLL

[76] Inventor: Joseph John Weishew, 1618 Pennsylvania Ave., Oreland, Pa. 19075

[21] Appl. No.: 484,066

[22] Filed: Jun. 6, 1995

[30] Foreign Application Priority Data

Dec. 23, 1994 [GB] United Kingdom ..... 9426166

[51] Int. Cl.[6] ..... B41F 31/00

[52] U.S. Cl. ..... 101/485; 101/349; 118/681; 118/708

[58] Field of Search ..... 101/349, 485, 101/350, 148, 170, 351, 348, 367, 352; 118/708, 668, 679, 680, 681, 682

[56] References Cited

U.S. PATENT DOCUMENTS

| | | | |
|---|---|---|---|
| 1,993,284 | 3/1935 | Roehm . | |
| 2,399,688 | 5/1946 | Metzner et al. . | |
| 2,613,600 | 10/1952 | McWhorter . | |
| 2,733,655 | 2/1956 | Boni . | |
| 2,762,295 | 11/1956 | Varga et al. . | |
| 2,887,050 | 5/1959 | Moser et al. . | |
| 3,283,712 | 11/1966 | Chambon . | |
| 3,345,941 | 10/1967 | Koch et al. . | |
| 3,353,484 | 11/1967 | Koyak . | |
| 3,563,173 | 2/1971 | Harless | 101/148 |
| 3,762,323 | 10/1973 | Hartka et al. | 101/350 |
| 3,762,324 | 10/1973 | Ivary | 101/350 |
| 3,818,830 | 6/1974 | Schultz | 101/350 |
| 3,916,791 | 11/1975 | Simeth | 101/141 |
| 3,981,238 | 9/1976 | Dini | 101/154 |
| 4,043,265 | 8/1977 | Grohman | 101/350 |
| 4,080,890 | 3/1978 | Dreher | 100/170 |
| 4,362,098 | 12/1982 | Stelling, Jr. et al. | 101/219 |
| 4,402,263 | 9/1983 | Honkawa | 101/350 |
| 4,446,814 | 5/1984 | Abendroth | 118/694 |
| 4,524,692 | 6/1985 | Rodvelt | 101/350 |
| 4,538,514 | 9/1985 | Simeth | 101/148 |
| 4,737,378 | 4/1988 | Narita et al. | 101/350 |
| 4,829,898 | 5/1989 | Wieland | 101/483 |
| 5,027,705 | 7/1991 | Guaraldi et al. | 101/148 |
| 5,069,124 | 12/1991 | Schneider | 101/142 |
| 5,081,928 | 1/1992 | Harrison | 101/351 |
| 5,090,315 | 2/1992 | Lee et al. | 101/351 |
| 5,090,316 | 2/1992 | Rodi et al. | 101/148 |
| 5,178,678 | 1/1993 | Koehler et al. | 118/46 |
| 5,201,272 | 4/1993 | Simon | 101/485 |
| 5,341,734 | 8/1994 | Jeschke et al. | 101/148 |
| 5,355,796 | 10/1994 | Köbler et al. | 101/148 |
| 5,408,928 | 4/1995 | Junghans et al. | 101/350 |

FOREIGN PATENT DOCUMENTS

| | | |
|---|---|---|
| 0 557 198 | 6/1996 | European Pat. Off. . |
| 2 672 542 | 8/1992 | France . |

*Primary Examiner*—Eugene H. Eickholt

*Attorney, Agent, or Firm*—Seidel Gonda Lavorgna & Monaco, P.C.

[57] ABSTRACT

A method of and apparatus for loading a wiper roll against an anilox roll, wherein the wiper roll and the anilox roll each have a longitudinal rotational axis. The wiper roll is rotated about its longitudinal rotational axis and moved in a translational direction towards the anilox roll. A controller detects rotational movement of the anilox roll and stops the translation movement of the wiper roll towards the anilox roll at a specific time after detecting the rotational movement of the anilox roll in order to properly load the wiper roll against the anilox roll.

9 Claims, 6 Drawing Sheets

METHOD OF AND APPARATUS FOR LOADING A WIPER ROLL AGAINST AN ANILOX ROLL

FIELD OF THE INVENTION

This invention relates to a two roll inking system in a flexographic printing system and more particularly to a method of automatically loading one of the rolls, a wiper roll, against the other roll, an anilox roll.

BACKGROUND OF THE INVENTION

In printing, there are numerous ways of transferring the ink to a substrate on which to print. One of these methods is flexographic printing, which is a process that uses rubber or another suitable material as a printing plate carried on a cylinder, to convey the image to the substrate, such as a corrugated board. There are several methods of getting the ink from its supply, such as a fountain, to the printing plate and ensuring delivery of the proper amount of ink.

One of the most common methods of ink delivery is to use an anilox roll. The anilox roll is flexible and has numerous small cells to hold the ink. The number of cells can vary from 30,000 to 300,000 cells per square inch. The anilox roll with ink transfers the ink to the printing plate. There are two common style machines or methods to fill the cells of the anilox roll and properly meter the ink. The two methods are using a doctor blade in conjunction with the anilox roll and using a wiper roll in conjunction with the anilox roll. This second style machine or method is sometimes referred to as two (2) roll inking or metering system.

The invention relates to a machine that uses the wiper roll to meter the ink to the anilox roll. Therefore, the prior art of this style of machine and method will be discussed in further detail. The anilox roll and the wiper roll form a nip created by the contact of these rolls together. This nip and the rolls form a trough which acts as an ink fountain. The contact force between the wiper roll and the anilox roll determines the amount of ink film which remains in the cells and on the anilox roll. This ink will be transferred to the printing plate. The minimum contact force occurs when the wiper roll just touches or "kisses" the surface of the anilox roll with enough force to form the nip and hold ink.

It has been recognized that to adjust the contact force, the wiper roll is mounted eccentrically in a housing relative to a frame. Rotation of the housing in the frame results in translational movement of the wiper roll relative to the anilox roll. The operator rotates a mechanical adjusting mechanism, such as a wrench, coupled to a gear engaging a rack on the housing in order to rotate the housing. The rotation moves the wiper roll translationally into or out of contact with the anilox roll. This movement is typically called the opening or closing of the wiper to the anilox roll. With this manual system, the operator could "feel" when the rolls initially make contact. The minimum contact force is defined as the "zero position."

One of the reasons for eccentrically mounting the wiper roll, is that the wiper roll in a flexo ink system has an elastic-type covering, such as rubber or another synthetic material, which is subject to wear. A worn roll can be removed from the ink fountain and refinished to produce a smoother wiping surface. However, this refinishing process reduces the diameter of the roll. In addition, the normal wear of the wiper roll from running the machine reduces the diameter of the wiper roll. Therefore, the center or longitudinal axis of the wiper roll needs to be adjusted in order to get the proper contact force.

While an operator with years of experience can tell by the resistance of the wrench that the wiper roll is in proper position therein giving the proper mount of contact force between rolls, it is desired to replace the manual movement by an automatic process so as to increase automation and speed production allowing the operator to perform other functions.

However, the automatic process does not have the benefit of the operator feeling the contact. Moreover, the contact torque cannot be adequately determined using feedback methods. It is therefore desired to have an apparatus for and a method of loading the wiper roll against the anilox roll wherein the "zero position" can be determined reliably and mechanically.

SUMMARY OF THE INVENTION

The present invention provides a method of and apparatus for loading a wiper roll against an anilox roll. The wiper roll and the anilox roll each have a longitudinal rotational axis. The wiper roll is rotated about its longitudinal rotational axis and moved in a translational direction towards the anilox roll. A controller detects rotational movement of the anilox roll and stops the translation movement of the wiper roll towards the anilox roll at a specific time after detecting the rotational movement of the anilox roll in order to properly load the wiper roll against the anilox roll.

One object, feature, and advantage resides in the provision of mechanically reliably loading the wiper roll against the anilox roll giving a true and consistent "zero position."

In the preferred embodiment, the controller loads the wiper roll with a desired specific contact force by waiting a specific time after detecting the rotational movement of the anilox roll, by determining the rate of translational movement of the wiper roll, and the position of the longitudinal axis of the wiper roll.

Another object, feature, and advantage resides in the provision of the capability of allowing the controller to continue rotating the eccentric housing therein moving the wiper roll translationally until an operator-selected contact force is achieved between the wiper roll and the anilox roll.

Other objects, aspects, and advantages of the present invention will be apparent to those skilled in the art upon reading the specification, drawings, and claims which follow.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

Figure 6:
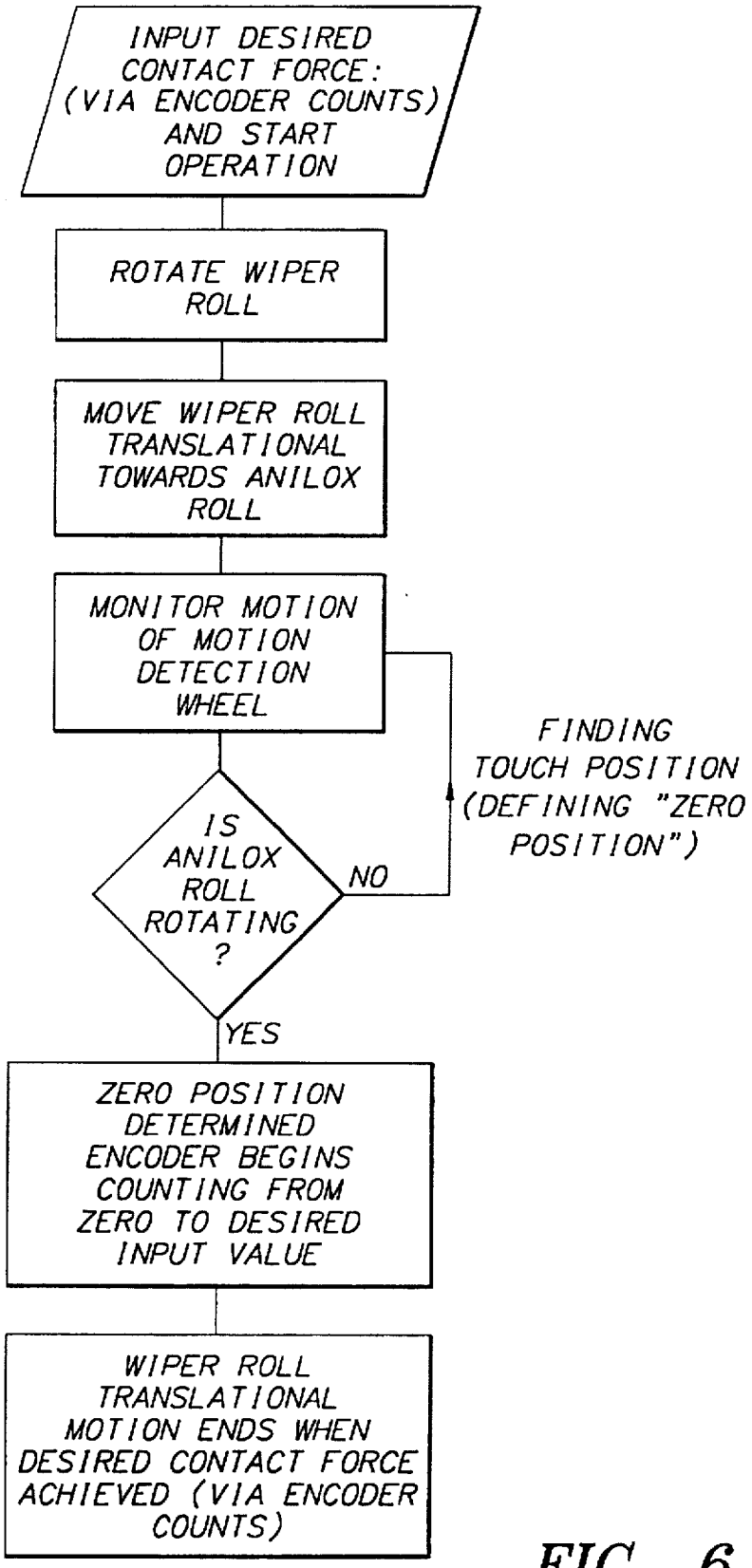

FIG. 6 is a schematic of the control process.

DETAILED DESCRIPTION OF THE DRAWINGS

Figure 2:
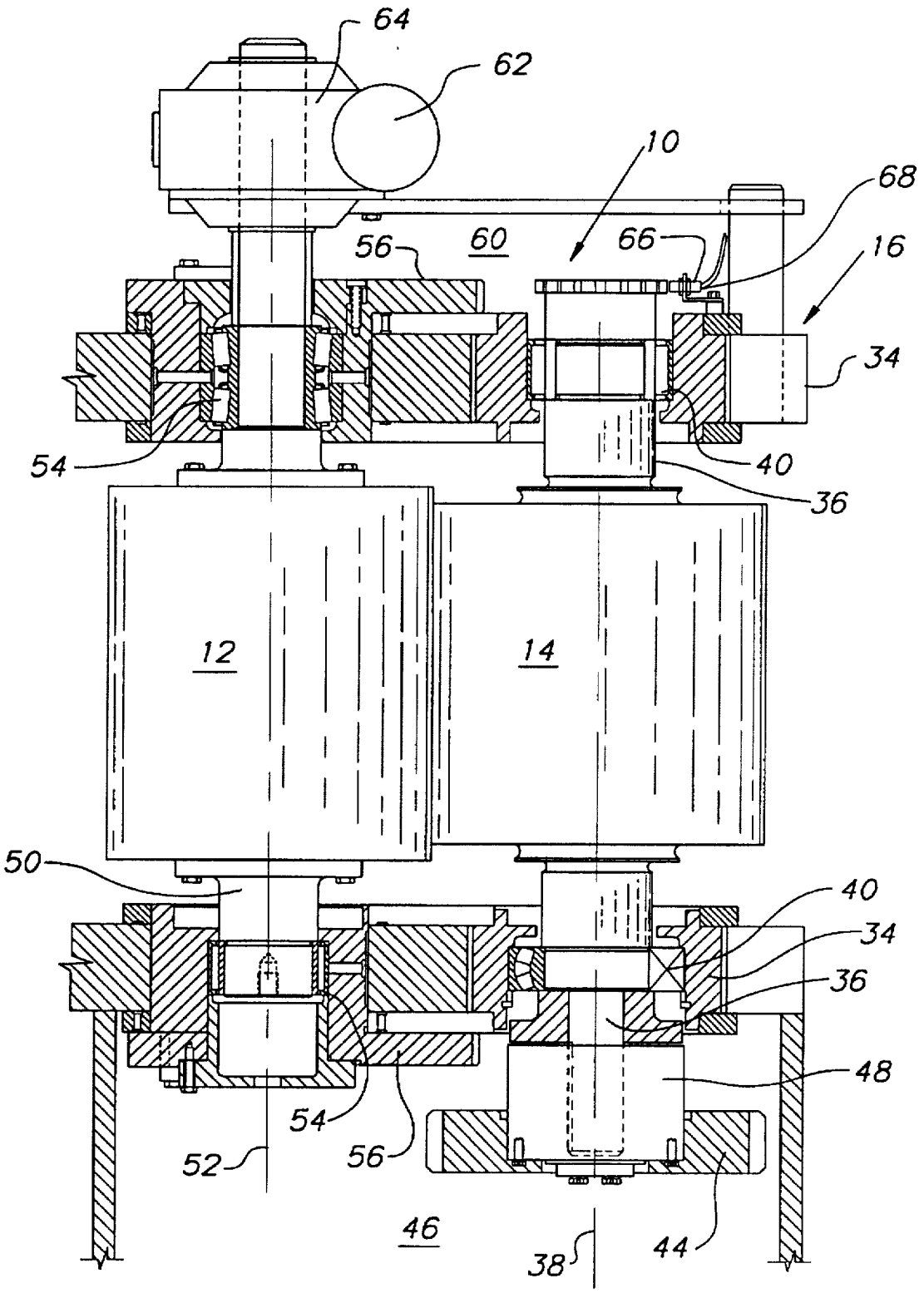
FIG. 2 is a cross-section view of the print station from above taken along line 2—2 in FIG. 1 showing the location of the wiper roll and the anilox roll.

Referring to the drawings, where like elements are identified by like numerals, there is shown in FIG. 2 a preferred embodiment of an apparatus for automatically loading a wiper roll 12 against an anilox roll 14 according to the invention designated by the numeral 10.

Figure 1:
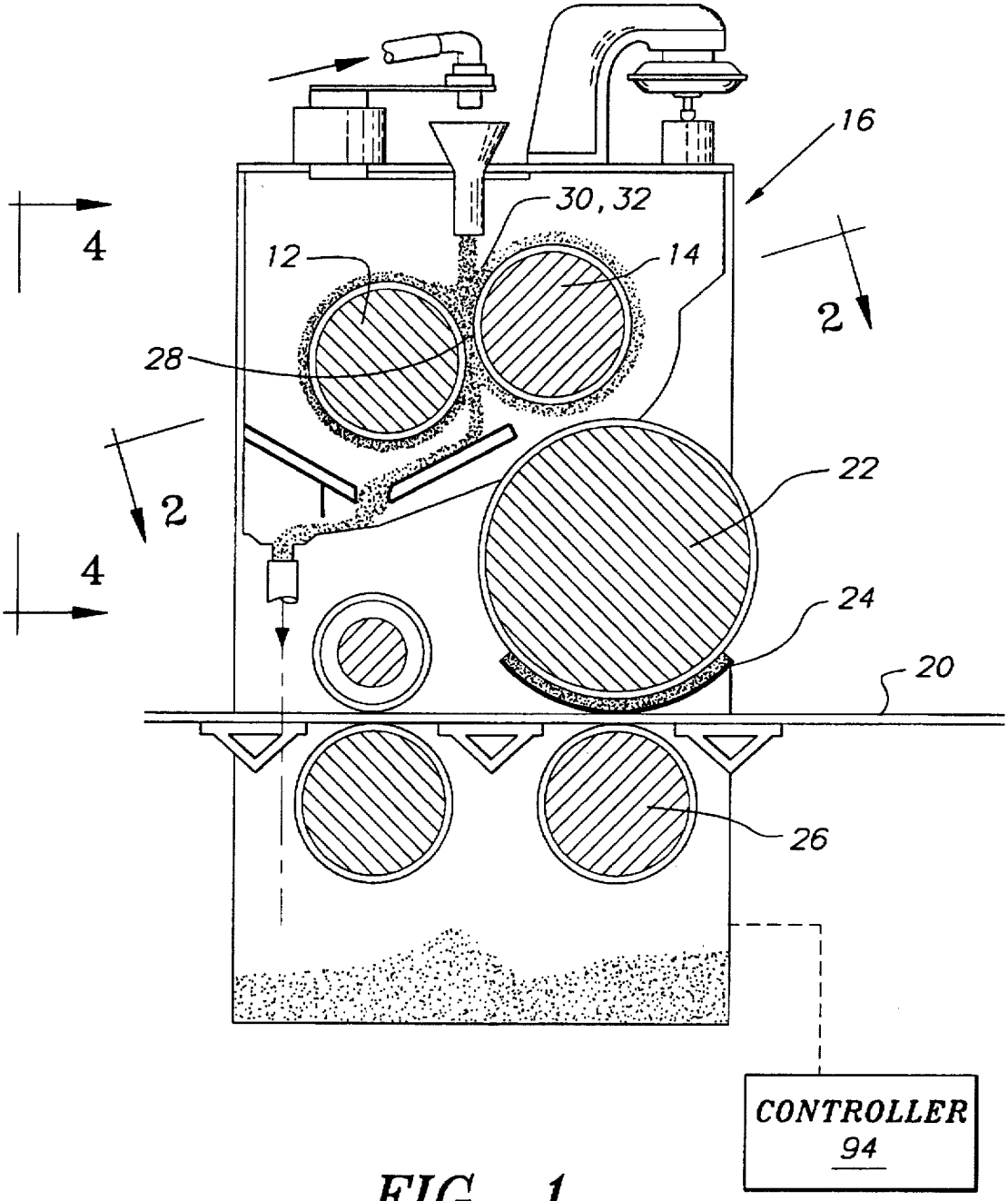
FIG. 1 is a simplified side elevation view of a print station of a corrugated box manufacturing machine having an apparatus for loading a wiper roll against an anilox roll in accordance with the present invention.

Referring to FIG. 1, a print station 16 in a corrugated box manufacturing machine, commonly referred to as a flexo folder gluer, prints on the upper surface of a corrugated board 20 as the board passes through the print station 16. The print station 16 has a print cylinder 22 having a printing plate 24 to place the image on the corrugated board 20. The print station 16 has an impression cylinder 26 to support the corrugated board 20 and act as an anvil for the printing plate 24.

The printing plate 24 has the image that is to be printed on the upper surface of the corrugated board 20. The printing plate 24 of the printing cylinder 22 receives the ink from the anilox roll 14 by the print plate 24 contacting the anilox roll 14 as the printing cylinder 22 and the anilox roll 14 rotate.

The anilox roll 14 and the wiper roll 12 form a nip 28 created by the contact of these rolls. This nip 28 and the rolls 12 and 14 form a trough 30 which acts as an ink fountain 32. The anilox roll 14 receives the ink from the ink trough 30.

The contact force between the wiper roll 12 and the anilox roll 14 determines the amount of ink film which remains on the anilox roll 14 along with the ink in the cells of the anilox roll. This ink will be transferred to the printing plate 24. The minimum contact force occurs when the wiper roll 12 just touches or "kisses" the surface of the anilox roll 14 with enough force to form a nip and hold ink. This minimum contact force is defined as the "zero position."

The wiper roll 12 in the print station 16 in the corrugated box manufacturing machine has an elastic-type covering, such as rubber or another synthetic material, which is subject to wear. As indicated in the Background of the Invention, the wearing of the wiper roll 12 by normal use or refinishing the wiper roll 12 reduces the diameter of the wiper roll 12. The wiper roll 12, therefore, is translationally movable relative to the anilox roll 14 in order to achieve the proper contact force. This process and associated structure for moving the wiper roll 12 is described below.

Referring to FIG. 2, the anilox roll 14 is cylindrical and symmetric about a longitudinal axis 38 extending through the ends of the anilox roll 14. The anilox roll 14 has a shaft 36 extending from both ends of the roll 14 along the longitudinal axis 38. The shaft 36 is rotatably mounted in a pair of bearings 40, allowing the anilox roll 14 to be rotated about its longitudinal axis 38. The bearings 40 are carried in a frame 34 of the print station 16.

Mounted on the shaft 36 at one end of the anilox roll 14 is a gear 44. This end of the anilox roll 14 and the print station 16 is commonly referred to as a gear side 46. The gear 44 is connected to the machine gear train. An over-running clutch 48 is interposed between the shaft 36 and the gear 44. The machine gear train rotates the anilox roll 14 at production speed to print on the corrugated board 20 passing between the printing plate 24 of the print cylinder 22 and the impression cylinder 26. The over-running clutch 48 permits free rotation of the anilox roll 14 when the machine is idle.

Referring to FIG. 2, the wiper roll 12, likewise, is cylindrical and symmetric about a longitudinal axis 52 extending through the ends of the wiper roll 12. The wiper roll 12 has a shaft 50 extending from both ends along the longitudinal axis 52. The shaft 50 is rotatably mounted in a pair of bearings 54 allowing the wiper roll 12 to be rotated about its longitudinal axis 52. Each bearing 54 is carried by a housing 56. The housings 56 are rotatably mounted in the frame 34.

The bearing 54 is eccentrically mounted in the housing 56 such that rotation of the housing 56 will move the longitudinal axis 52 of the wiper roll 12 towards or away from the longitudinal axis 38 of the anilox roll 14. This movement is commonly referred to as the opening or closing of the wiper roll 12 to the anilox roll 14.

Figure 3:
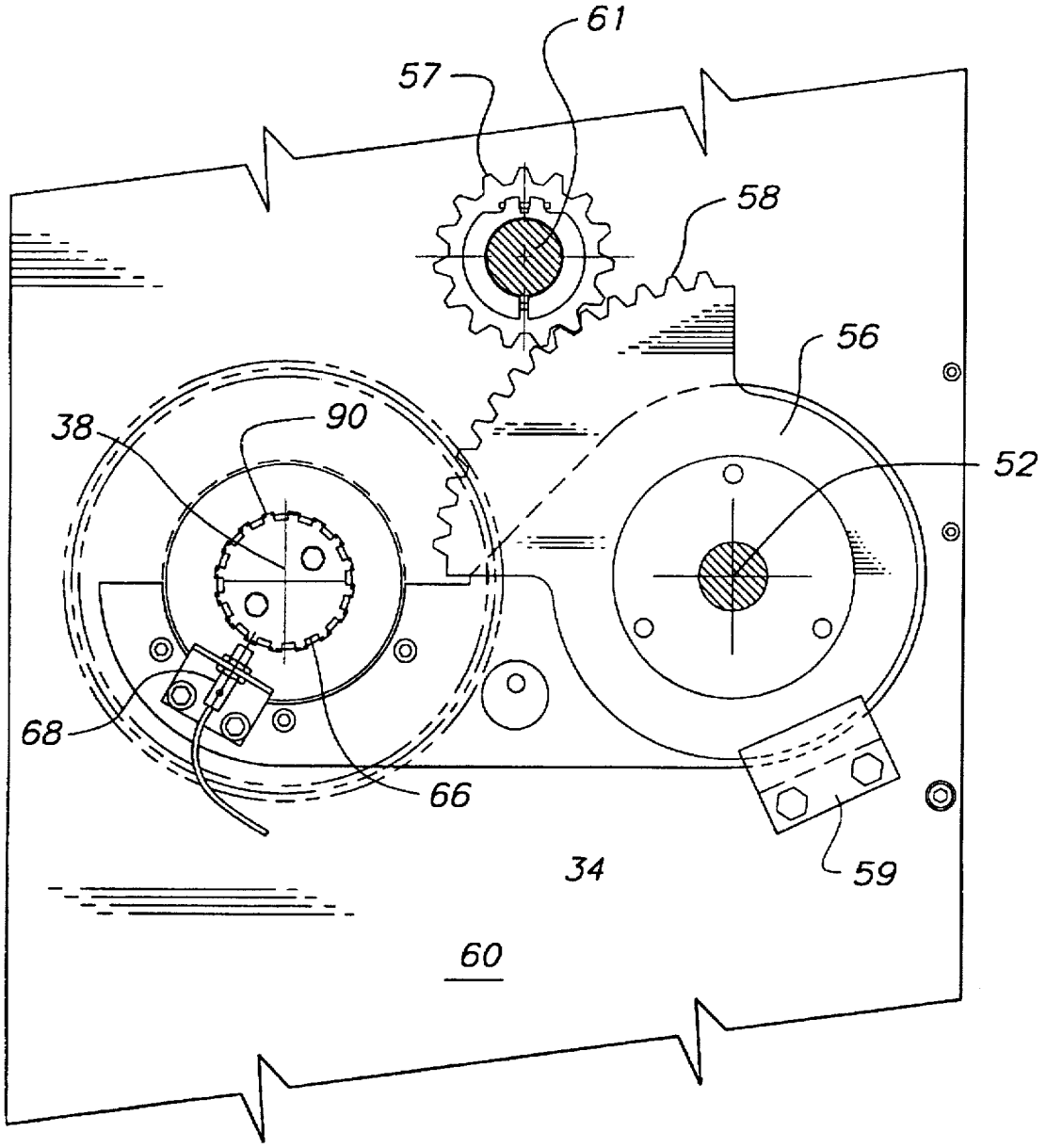
FIG. 3 is side view of the upper portion of the print station showing a housing for eccentrically mounting the wiper roll.

Referring to FIG. 3 showing the non-gear side, commonly referred to as a drive side 60, the housing 56 has a rack 58, a series of teeth, that are engaged by a pinion, gear, 57 to rotate the housing 56. In addition, a bracket 59 carded by the frame 34 slidable guides the rotation of the housing 56. The gear side 46 has a similar arrangement, and a shaft 61 extends between the pair of pinions 57. The rotation of the housing 56 typically moves the longitudinal axis 52 of the wiper roll 12 translationally less than ⅛ inch towards and away from the longitudinal axis 30 of the anilox roll 14.

Referring back to FIG. 2, connected to the shaft 50 of the wiper roll 12 at the non gear side, commonly referred to as the drive side 60, is a constant speed motor 62 for rotating the wiper roll 12. The constant speed motor 62 is connected to the shaft 50 through a reduction gear 64. The constant speed motor 62 rotates the wiper roll 12 during production to keep the ink flowing in the ink trough 30. The wiper roll 12 rotates at a rate slower than the anilox roll 14 during typical production runs.

Figure 4:
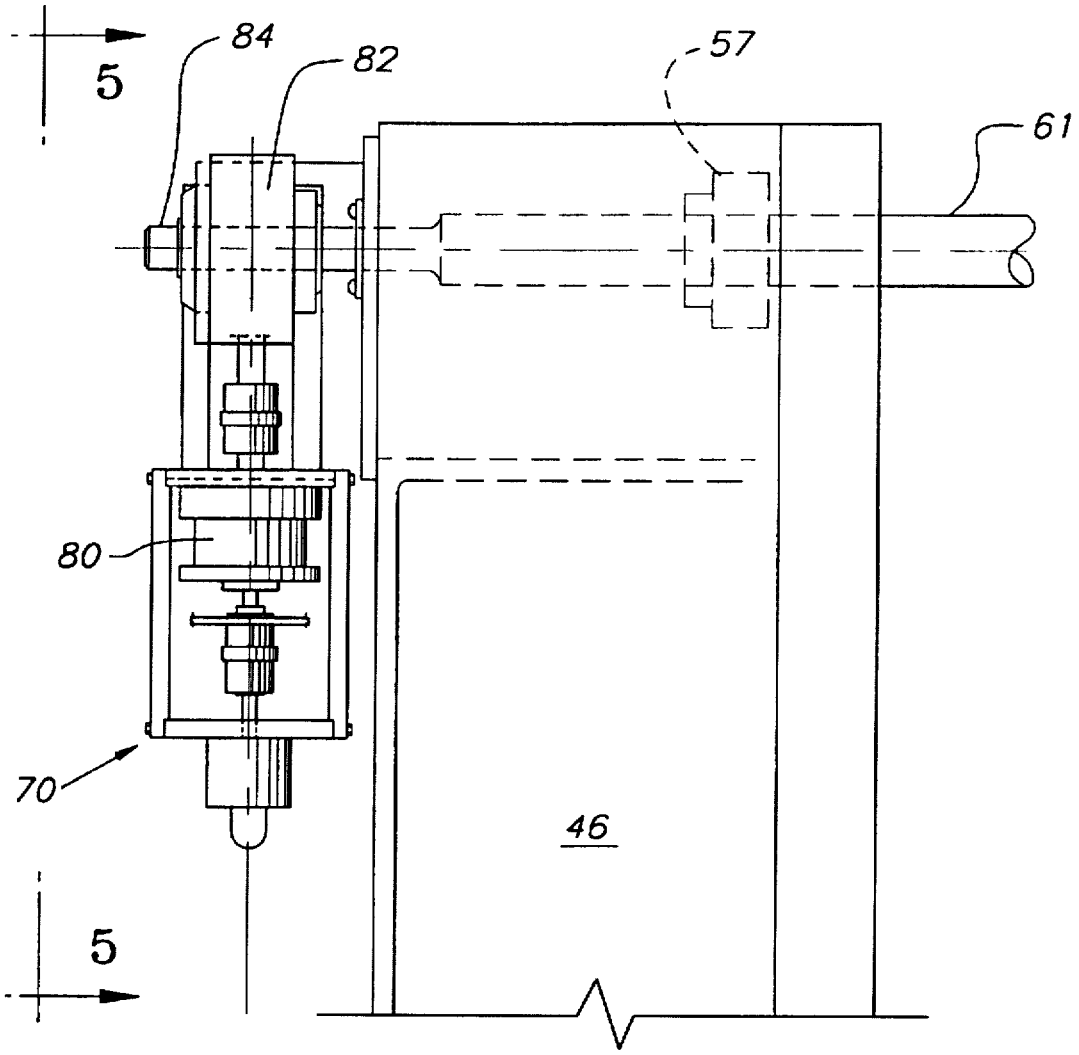
FIG. 4 is a rear view, referred to as a gear side, of the upper portion of the print station taken along line 4—4 in FIG. 1 showing the drive means for rotating the housing carrying the wiper roll.
Figure 5:
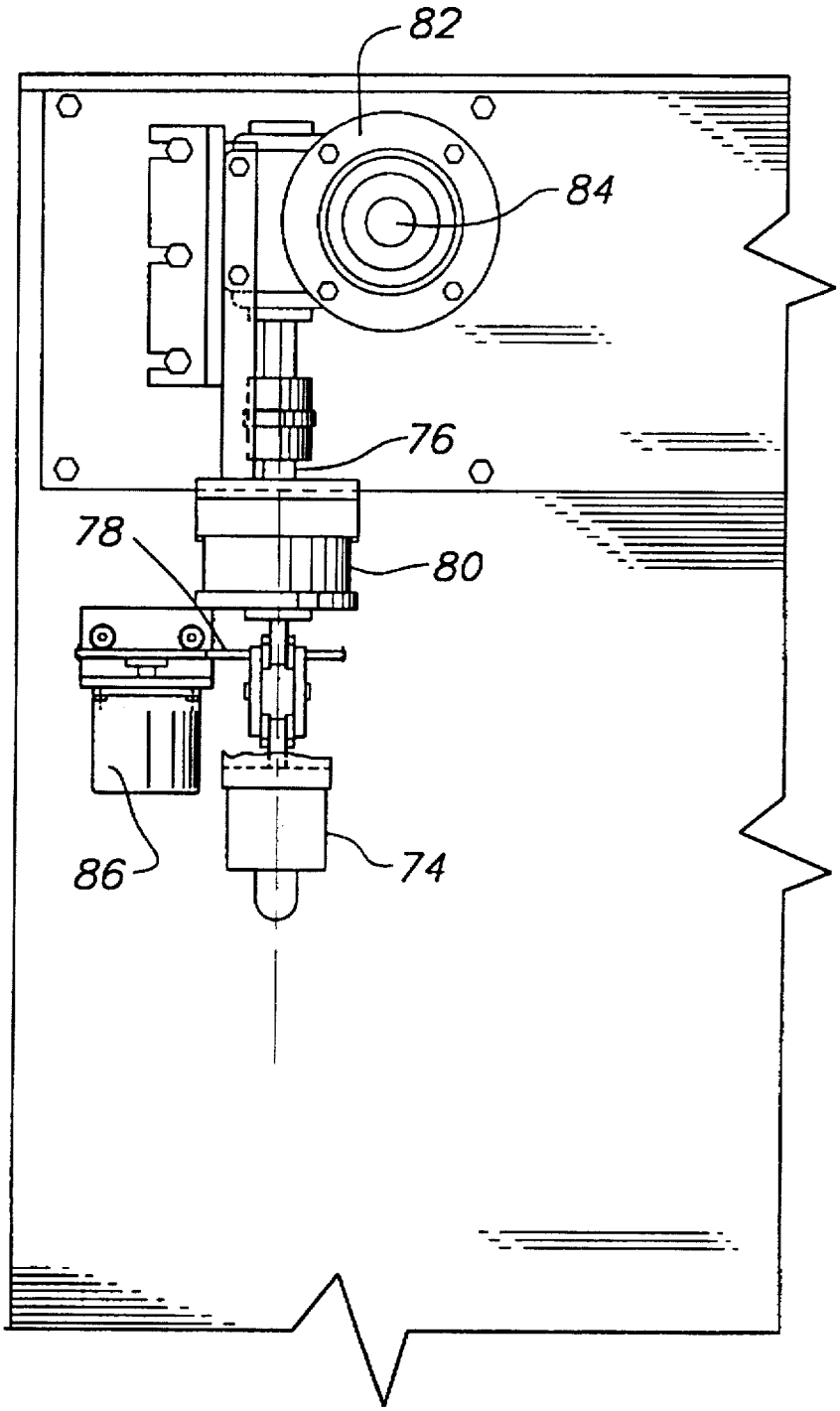
FIG. 5 is a side elevation of the upper portion of the print station on the gear side taken along line 5—5 in FIG. 4 showing the drive means for rotating the housing carrying the wiper roll.

The improvement 10 for automatically loading a wiper roll 12 against an anilox roll 14 includes a motion detection wheel 66 on the anilox roll 14, a sensor 68, as seen in FIG. 3, and a drive means 70 for moving the wiper roll 12 towards and away from the anilox roll 14, as seen in FIGS. 4 and 5.

Referring to FIGS. 4 and 5 showing the gear side 46 of the machine, the drive means 70 has an air motor 74, best seen in FIG. 5, connected to a drive shaft 76. The drive shaft 76 comes in several sections and includes several interposed components. The components include a pair of reduction gear assemblies 80 and 82. One of the reduction gear assemblies 82, at the upper end of the shaft 76, engages an extension 84. One of the gears, not shown, of the reduction gear assembly 82 encircles one end of the extension 84. The gear is keyed to the extension 84 so that they rotate together. The extension 84, at the other end, is coupled to the pinion 57, shown in FIG. 3 and in hidden line in FIG. 4, and the shaft 61 in proximity to the air motor 74. An encoder 86 is connected to the shaft 76 by a series of gears 78.

Referring back to FIG. 3, the motion detection wheel 66 is mounted on the shaft 36 of the anilox roll 14 on the drive side 60 of the print station 16. The motion detection wheel 66 has a series of teeth 90. The series of teeth 90 of the motion detection wheel 66 work in cooperation with the sensor 68 to determine when the anilox roll 14 is rotating. The sensor 68 in the preferred embodiment is a proximity switch such as a QS132 proximity switch sold by MC Technologies. The sensor 68 is typically positioned in the preferred embodiment such that the end of the sensor 68 is 0.040 inches from the teeth 90 of the motion detection wheel 66.

In Operation

The flexo folder gluer 18, or the print station 16, has a controller 94, as shown in schematic in FIG. 1, which controls the loading of the wiper roll 12 against the anilox roll 14. Referring to FIG. 6, upon activation by the operator, the controller 94 begins the rotation of the wiper roll 12 by powering the constant speed motor 62, shown in FIG. 2. In addition, the controller 94 simultaneously or slightly prior to or after beginning the rotation of the wiper roll 12, begins the movement of the wiper roll 12 towards the anilox roll 14.

The controller 94 performs this operation of moving the wiper roll 12 translationally, by having the air motor 74 rotate the pinion 57 on the gear side 46 through the drive shaft 76, and the extension 84. The pinion 57 on the drive side 60 of the machine is coupled to the pinion 57 on the gear side 46 via the shaft 61. The drive shaft 76 includes the pair of reduction gear assemblies 80 and 82. The pinions 57 each engage the rack 58 on one of the housing 56, respectively, rotating the housing 56. The rotation of the housing 56 moves the wiper roll 12 in the translational direction towards the anilox roll 14.

The controller 94 receives information from the sensor 68 which monitors movement of the anilox roll 14. When the sensor 68 determines the anilox roll 14 begins to rotate, the sensor 68 sends the signal to the controller 94. The sensor 68 detects the motion of the anilox roll 14 by watching for movement of the motion detection wheel 66. As indicated above, the anilox roll 14 will begin to rotate when the wiper roll 12, which is rotated by the constant speed motor 62, engages the anilox roll 14 with sufficient contact force to begin rotation of the anilox roll 14 (i.e. the "zero position"). The over-running clutch 48 allows the anilox roll 14 to rotate even though the machine gear train is not rotating.

The encoder 86 which is connected to the drive shaft 76 forwards a signal to the controller 94, therein the controller 94 knows the position of the drive shaft 76 and through an algorithm related to the geometry of the system (i.e. gear reduction and gear size), determines the position of the longitudinal axis 52 of the wiper roll 12. In the preferred embodiment, the controller 94 resets the encoder 86 to zero (i.e., the "zero position") when the sensor determines the anilox roll 14 has begun to rotate.

When the controller 94 determines the "zero position," the controller 94 stops the translational movement of the wiper roll 12 either immediately or after a specific time period. The controller 94 determines when to stop the translational movement of the wiper roll 12 by considering one, some, or all of these factors: the contact force desired as input by the operator, the rate of translational movement of the wiper roll 12, and the size of the wiper roll 12. The size of the wiper roll 12 is determined by the controller 94 by knowing the position of the longitudinal axis 52 of the wiper roll 12 through the encoder 86 at the time the anilox roll 14 begins to rotate. In the preferred embodiment, the contact force is input as the number of encoder counts after the zero position.

With the wiper roll 12 properly loaded against the anilox roll 14, the printing of the corrugated board 20 can begin with the proper mount of ink engaging the printing plate 24, thus the printing upper surface of the corrugated board 20.

In addition, the controller 94 by determining the "zero position" can prevent the wiper roll 12 from inadvertently being moved out of contact with the anilox roll 14. If the rolls 12 and 14 were separated, the ink in the trough 30 would drain into the machine.

The present invention may be embodied in other specific forms without departing from the spirit or essential attributes thereof and, accordingly, reference should be made to the appended claims, rather than to the foregoing specification, as indicating the scope of the invention.

I claim:

1. A method of loading a first roll against a second roll comprising the following steps:

rotating one of the rolls;

moving the rolls relative to each other in a translational direction until the rolls contact each other;

detecting an initial rotational movement of the other roll when it is caused to rotate by contacting the rotating one roll; and stopping the relative movement in the translational direction of the rolls upon detecting said initial rotation.

2. A method of loading a wiper roll against an anilox roll comprising the following steps:

providing the wiper roll and the anilox roll each with a longitudinal rotational axis;

rotating the wiper roll about the longitudinal rotational axis of the wiper roll;

moving the wiper roll translationally, in a direction perpendicular to the longitudinal axis, towards the anilox roll;

detecting an initial rotational movement of the anilox roll when it is caused to rotate by contacting the rotating wiper roll; and stopping the translational movement of the wiper roll towards the anilox roll at a specific time after detecting the rotational movement of the anilox roll.

3. A method of loading a wiper roll against an anilox roll comprising the following steps:

providing the wiper roll and the anilox roll each with a longitudinal rotational axis;

rotating the wiper roll about the longitudinal rotational axis of the wiper roll;

moving the wiper roll translationally, in a direction perpendicular to the longitudinal axis, towards the anilox roll;

detecting rotational movement of the anilox roll; and stopping the translational movement of the wiper roll towards the anilox roll at a specific time after detecting the rotational movement of the anilox roll, wherein the specific time after detecting the rotational movement of the anilox roll is based upon a specific contact force desired, the rate of translational movement of the wiper roll, and the position of the longitudinal axis of the wiper roll.

4. In an apparatus having a first roll and a second roll, each roll having a longitudinal axis, each roll being rotatable about its longitudinal axis, the first roll having a gear for coupling the first roll to a drive means, the drive means rotating at a rate associated with the production rate, an overrunning clutch associated with the first roll for allowing rotation of the first roll without rotation of the drive means, eccentric mounting means for rotatably mounting the second roll in a housing wherein rotation of the eccentric mounting means moves the longitudinal axis of the second roll relative to the first roll, the eccentric mounting means having an engagement means adapted to allow rotation of the eccentric mounting means, a motor carried by the frame for rotating the second roll, wherein the improvement comprises:

a. drive means engaging the engagement means for rotating the eccentric mounting means therein moving the second roll towards and away from the first roll, b. sensor means for detecting rotation of the first roll, and c. control means for moving the drive means and beginning rotation of the motor for rotating the second roll in its longitudinal axis, determining when the second roll contacts the first roll by detecting rotation of the first roll by the sensor means, and stopping the drive means therein stopping the translational movement of the second roll.

5. In an apparatus as in claim 4 wherein further comprising feedback means for measuring the angular displacement of the eccentric mounting means.

6. In an apparatus as in claim 5 wherein the control means calculates the stopping of the translational movement of the second roll in response to a specific contact force desired, the rate of translational movement of the second roll, the position of the second roll from the feedback means when the second roll contacts the first roll by detecting rotation of the first roll by the sensor means.

7. In a printer for printing on a substrate, the printer having an anilox roll and a wiper roll, the anilox roll having a longitudinal axis, and a shaft along the longitudinal axis, the anilox roll being rotatable about its shaft, a gear coupled to the shaft of the anilox roll for rotating the anilox roll with a machine gear train of the printer, clutch means for allowing rotation of the anilox roll without rotation of machine gear train;

the wiper roll having a longitudinal axis, and a shaft along the longitudinal axis, the wiper roll being rotatable about its shaft, a housing having a rack, the housing rotatably mounted in the frame, a pinion rotatably mounted to the frame for engaging the rack of the housing for rotating the housing relative to the frame, a motor carried by the frame and movable with the shaft of the wiper roll for rotating the wiper roll;

wherein the improvement comprises a. a motor for rotaing the pinion therein moving the eccentric housing of the wiper roll, the eccentric housing moving the longitudinal axis of the wiper roll translationally towards and away from the anilox roll;

b. motion detector mounted to the shaft of the anilox roll, c. sensor means for detecting rotation of the motion detector of the anilox roll, and d. control means for moving the drive means and beginning rotation of the motor for rotating the wiper roll in its longitudinal axis, determining when the wiper roll contacts the anilox roll by detecting rotation of the anilox roll by the sensor means, and stopping the drive means therein stopping the translational movement of the wiper roll.

8. In a printer as in claim 7 wherein further comprising feedback means for measuring the angular displacement of the eccentric housing.

9. In a printer as in claim 8 wherein the control means calculates the stopping of the translational movement of the wiper roll in response to a specific contact force desired, the rate of translational movement of the wiper roll, the position of the wiper roll from the feedback means when the wiper roll contacts the anilox roll by detecting rotation of the anilox roll by the sensor means.

* * * * *